United States Patent [19]

Bachhuber et al.

[11] 4,048,899

[45] Sept. 20, 1977

[54] SHOTGUN SHELL CRIMPER

[75] Inventors: Theodore J. Bachhuber; Philip C. Bachhuber, both of Mayville, Wis.

[73] Assignee: Mayville Engineering Company, Inc., Mayville, Wis.

[21] Appl. No.: 709,695

[22] Filed: July 29, 1976

[51] Int. Cl.[2] ..... F42B 33/12

[52] U.S. Cl. ..... 86/39; 86/23

[58] Field of Search ..... 86/23, 24, 25, 26, 27, 86/28, 29, 30, 31, 32, 33, 36, 37, 38, 39, 40, 41

[56] References Cited

U.S. PATENT DOCUMENTS

| | | | |
|---|---|---|---|
| 464,987 | 12/1891 | Pearson | 86/27 |
| 644,493 | 2/1900 | Blakeman | 86/41 |
| 3,048,077 | 8/1962 | Shelton | 86/40 |
| 3,157,086 | 11/1964 | Bachhuber | 86/27 |
| 3,196,736 | 7/1965 | Pace | 86/39 X |
| 3,323,405 | 6/1967 | Thorp | 86/24 X |

*Primary Examiner*—Harold Tudor

*Attorney, Agent, or Firm*—Wheeler, Morsell, House & Fuller

[57] ABSTRACT

A crimping die which is movably mounted in one end of a shotgun shell crimping sleeve has a conically shaped side wall which permits the crimped end of the shell to overhang the crimping die to cause ironing of the crimped end of the shell against the rounded crimping corner of the crimping sleeve when the crimping die is withdrawn from the crimped shell.

3 Claims, 4 Drawing Figures

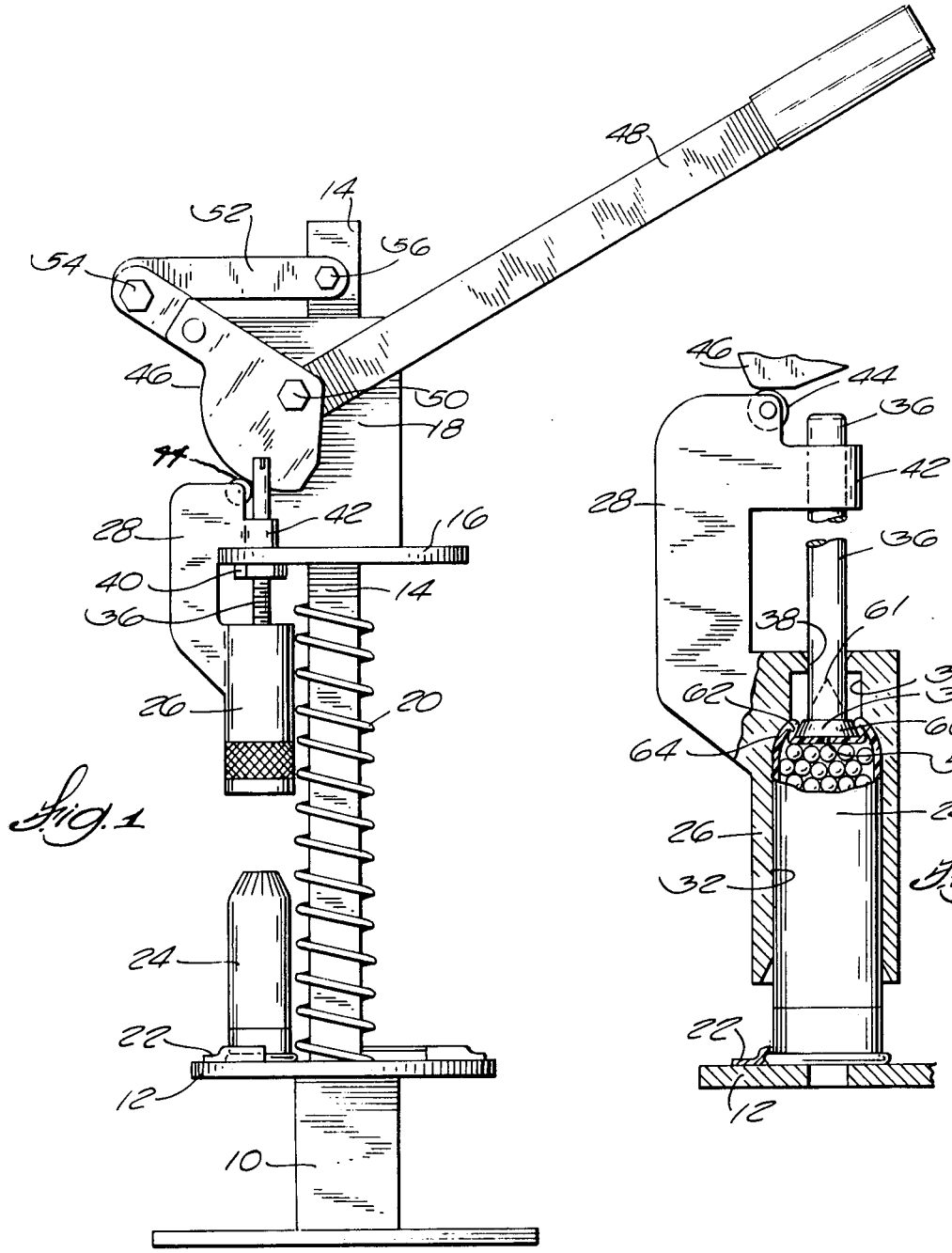
Fig. 1
Fig. 3
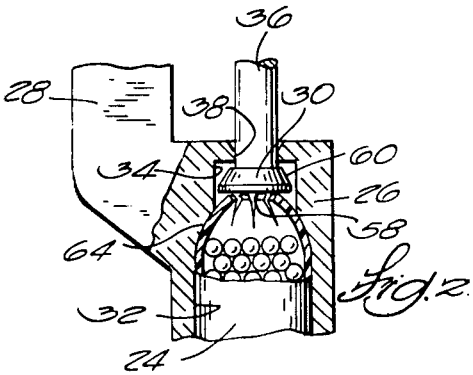
Fig. 2
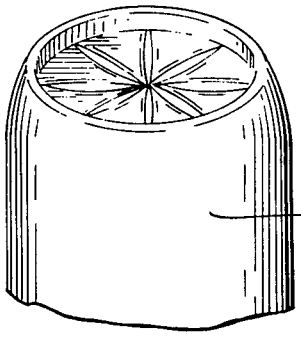
Fig. 4

SHOTGUN SHELL CRIMPER

BACKGROUND OF THE INVENTION

This invention relates to shotgun shell crimpers for reloading shotgun shells. One problem in reloading shotgun shells is that the crimped end of the reloaded shell tends to be slightly rough on its exterior surface from having been crimped more than once. The principal object of this invention is to provide a means of smoothing the exterior end of the crimped shell so as to expedite chambering of the reloaded shell.

SUMMARY OF THE INVENTION

In accordance with this invention, it has been found that the exterior of the crimped end of a shotgun shell can be smoothed by utilizing a crimping die having a conical side wall which permits the crimped end of the shell to overhang the crimping die to cause ironing of the crimped end of the shell against the rounded crimping corner of the crimping sleeve when the crimping die is withdrawn from the crimped shell. U.S. Pat. 3,157,086 exemplifies the prior art.

DESCRIPTION OF THE DRAWINGS

FIG. 1 is an side elevational view of a shotgun shell crimping tool.

FIG. 2 is a fragmentary longitudinal sectional view of the upper end of the shotgun shell crimping sleeve of FIG. 1 with an uncrimped reloaded shell therein and the crimping die in its retracted position.

FIG. 3 is a longitudinal sectional view of the shotgun shell crimping sleeve of FIG. 1 with a crimped reloaded shell therein and the crimping die in its extended position.

FIG. 4 is a fragmentary perspective view of the crimped end of a shotgun shell.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Referring to FIG. 1, the preferred embodiment of this invention includes a base 10 upon which a work table 12 is rigidly mounted. A post 14 is rigidly attached to base 10 and extends upwardly through the center of work table 12. A tool carriage 16 having a collar portion 18 is slideably mounted on post 14 and is urged upwardly by a compression spring 20. A conventional shotgun shell holder 22 which is slotted to receive the flange portion of the shell is affixed to the top of work table 12 for holding a reloaded shotgun shell 24 to be crimped, and a crimper which includes a crimping sleeve 26, mounting bracket 28, and crimping die 30 (FIG. 3) is attached to tool carriage 16 above shotgun shell holder 22.

Crimping sleeve 26 has a generally cylindrical interior cavity 32 (FIGS. 2 and 3) that is dimensioned to receive an uncrimped shotgun shell as shown in FIG. 2 and has a contiguous cylindrical cavity 34 of smaller radius within its uppermost end in FIGS. 1-3 within which crimping die 30 is slideably mounted on rod 36. Rod 36 extends through an opening 38 in the upper end of crimping sleeve 32 and is rigidly attached to tool carriage 16 by an adjustment nut 40 (FIG. 1). Nut 40 is welded to tool carriage 16 and engages threads on rod 36. The position of crimping die 30 relative to tool carriage 16 can be adjusted by rotating the end of rod 36 which extends above tool carriage 16.

The mounting bracket 28 for crimping sleeve 26 has a sleeve portion 42 which slideably engages the portion of rod 36 that extends above tool carriage 16. A cam roller 44 is mounted on top of bracket 28 and engages a cam surface 46 on a V-shaped manual actuating lever 48 which is pivotally attached to tool carriage collar 18 on pintle 50. Manual actuating lever 48 is pivotally connected at its left hand end in FIG. 1 to post 14 by link 52 and pintles 54 and 56. When the right hand end of manual actuating lever 48 in FIG. 1 is lowered, it drives tool carriage 16 downward against the force of spring 20, with crimping sleeve 26 being held in the position shown in FIG. 1 relative to tool carriage 16 by the contact between cam surface 46 and cam roller 44. As tool carriage 16 drops down, crimping sleeve 26 slides down over shotgun shell 24 until the relative position shown in FIG. 2 is reached. At this time, cam surface 46 clears cam roller 44 and permits crimping sleeve 26 to remain stationary as tool carriage 16 continues to drop. The continued downward movement of tool carriage 16 pushes the end wall 58 of crimping die 30 against the puckered end of shotgun shell 24 and crimps it as shown in FIGS. 3 and 4.

The novel structural feature of the invention lies in the shape of crimping die 30. In the past, crimping die 30 has been a right circular cylinder. In this invention, the side wall 60 of crimping die 30 is conical in shape, the apex 61 of the cone lying on the side of the die opposite the crimping wall thereof, which is the end of the die adjacent to the shotgun shell. The apex portion of the cone is cut off so that crimping die 30 is shaped as a frustum of a cone. Conical side wall 60 permits the crimped end of shotgun shell 24 to overhang crimping die 30 at the end of the crimping stroke as shown at 62 in FIG. 3. Then, when crimping die 30 is withdrawn from the crimped end of shotgun shell 24, conical side wall 60 irons the crimped end of shell 24 against the rounded crimping corner 64 of crimping sleeve 26 as crimping die 30 is lifted off or withdrawn from the crimped end of shell 24. This smooths the end of shell 24 and expedites chambering of the shell.

Although the crimper is shown mounted on a single station tool herein, it will be understood that the same crimper could also be mounted on a multiple station reloading tool without any change in the essential parts. Also, although work table 12 is shown as fixed and tool carriage 16 as movable, this relationship could be reversed if desired without altering any essential features of the invention.

I claim:

1. In a shotgun shell crimper having a crimping sleeve with a cylindrical interior cavity which is dimensioned to fit over the exterior surface of an uncrimped shotgun shell, having a rounded crimping corner on one end of said cavity, and having a crimping die movably mounted in said one end of said cavity in position to crimp the end of said shotgun shell, said crimping die having an end wall engageable with the end of a said shotgun shell and a side wall joined to the end wall, the improvement wherein said side wall is generally conical and smaller in diameter than said end wall except where said side wall and said end wall meet and the base of said generally conical shape lies on the side of said crimping die toward said shotgun shell, to permit the crimped end of the shell to overhang the crimping die to cause ironing of the crimped end of the shell against said rounded crimping corner when the crimping die is withdrawn from the crimped shell.

2. The shotgun shell crimper of claim 1 wherein said side wall is frusto-conical in shape.

3. The shotgun shell crimper of claim 1 wherein said crimping sleeve and said crimping die are mounted so that the crimping die moves downwardly after the crimping sleeve has completed its downward motion and moves upwardly before said crimping sleeve commences its upward motion, a work station having means for fixing a shotgun shell thereto, said sleeve being mounted to move toward the open end of a shotgun shell fixed at said work station, said die being mounted to move toward the open end of said shell after said sleeve has completed its movement towards said shell and to move away from the end of said shell before said sleeve begins to move away from said shell, all of said motions being relative to the position of the work station, whereby the largest diameter of said die where said side wall and end wall meet exerts great pressure on the portion of the side wall of said shell overlying the reduced diameter portions of the sides of said die as said die is moved relatively away from said work station and the end of said shell.

* * * * *